US007415856B2

(12) United States Patent
Bauersachs et al.

(10) Patent No.: US 7,415,856 B2
(45) Date of Patent: Aug. 26, 2008

(54) METHOD AND DEVICE FOR SHAPING AND THEN LIFTING A WORKPIECE

(75) Inventors: Lothar Bauersachs, Weidhausen (DE); Harald Barnickel, Niederfüllbach (DE)

(73) Assignee: Langenstein & Schemann GmbH, Coburg (DE)

( * ) Notice: Subject to any disclaimer, the term of this patent is extended or adjusted under 35 U.S.C. 154(b) by 101 days.

(21) Appl. No.: 10/564,753

(22) PCT Filed: May 28, 2004

(86) PCT No.: PCT/EP2004/005779

§ 371 (c)(1),
(2), (4) Date: Jan. 13, 2006

(87) PCT Pub. No.: WO2005/023455

PCT Pub. Date: Mar. 17, 2005

(65) Prior Publication Data

US 2006/0169017 A1 Aug. 3, 2006

(30) Foreign Application Priority Data

Aug. 8, 2003 (DE) ..... 103 36 469

(51) Int. Cl.
*B21J 13/10* (2006.01)
*B21D 43/04* (2006.01)
*B21D 43/10* (2006.01)

(52) U.S. Cl. ..... 72/20.5; 72/421

(58) Field of Classification Search ..... 72/20.5, 72/20.3, 20.1, 405.01, 405.16, 421, 405.09
See application file for complete search history.

(56) References Cited

U.S. PATENT DOCUMENTS

| | | | | |
|---|---|---|---|---|
| 3,831,425 | A | 8/1974 | Kita | |
| 4,585,389 | A * | 4/1986 | Watanabe et al. | 198/750.12 |
| 5,105,647 | A * | 4/1992 | Maher | 72/405.13 |
| 5,231,860 | A * | 8/1993 | Tsuruta et al. | 72/20.1 |
| 5,454,262 | A * | 10/1995 | Westermeyer | 72/421 |
| 5,640,875 | A * | 6/1997 | Horde et al. | 72/405.13 |

FOREIGN PATENT DOCUMENTS

| | | | |
|---|---|---|---|
| DE | 2746161 | A1 | 4/1979 |
| DE | 3109902 | A1 | 11/1982 |
| DE | 4326924 | A1 | 2/1995 |
| DE | 10060709 | A1 | 6/2002 |

* cited by examiner

*Primary Examiner*—Daniel C Crane
(74) *Attorney, Agent, or Firm*—Workman Nydegger

(57) ABSTRACT

Implementations of the present invention relate to a method and a corresponding device for shaping a workpiece, in which the lifting of the workpiece from the tool after a shaping process is automated. One implementation of the method relates to (a) placing the workpiece in a shaping position on a first tool of the shaping machine, (b) moving the tools of the shaping machine toward one another, (c) shaping the workpiece between the tools, (d) subsequently moving the tools away from one another, (e) identifying a triggering time when the relative motion of the tools has reached a reference position.,(f) determining a lifting time, which may be a function of the triggering time, and (g) initiating a lifting motion of the workpiece from the first tool by at least one handling device at lifting time.

46 Claims, 5 Drawing Sheets

METHOD AND DEVICE FOR SHAPING AND THEN LIFTING A WORKPIECE

BACKGROUND OF THE INVENTION

1. Field of the Invention

The invention relates to a method and a device for shaping a workpiece.

2. Background and Related Art

Percussive shaping machines such as hammers and screw presses, in particular flywheel screw presses, are known for industrial forging of workpieces. Percussive shaping machines comprise a working region in which two tools are movable, generally in a straight line, relative to one another. The workpiece is positioned between the two tools, and is then shaped by the impact force or impact energy from the striking of the tools on the workpiece and the resulting shaping energy.

According to VDI-Lexikon "Produktionstechnik Verfahrenstechnik" [Manufacturing Process Engineering], Prof. Dr. Hiersig, Publisher, VDI-Verlag, 1995, pages 1107-1113, forging hammers may be subdivided into anvil hammers—which in turn are subdivided into drop hammers and double-acting hammers—and counterblow hammers. An anvil hammer comprises an anvil (or support) as a tool that is stationary with respect to the workpiece, and a striking hammer, or hammer for short, as a tool that is movable, generally vertically, with respect to the workpiece and to the anvil. A counterblow hammer comprises two striking hammers that are movable, vertically or also horizontally, with respect to one another and relative to the base or the hammer frame. The drives for the hammers of forging hammers are generally hydraulic or pneumatic. In the actual shaping or work procedure, both the hammer frame and the hammer drives of a forging hammer are relieved of the shaping force so as not to overload the forging hammer. For screw presses, the workpiece that is moved is generally referred to as a tappet. The tappet is moved by a spindle in a straight line toward the stationary tool. The drive of the spindle, and thus of the tappet, is provided by a drive motor and/or a flywheel as an energy store. Before striking the workpiece located on the stationary tool, the spindle or tappet is decoupled from the drive, and the kinetic energy imparted to the tappet is (partially) transformed into shaping energy (VDI-Lexikon, see above).

For automatic handling of workpieces during pressing or forging, the use of handling devices such as manipulators and industrial robots is known from VDI-Lexikon "Produktionstechnik Verfahrenstechnik," Prof. Dr. Hiersig, Publisher, VDI-Verlag, 1995, pages 848, 849, and 1214. Such handling devices have grippers for grasping and temporarily holding workpieces, and insert the workpieces into or remove them from the forging machine. Manipulators are manually controlled motion devices which as a rule have distinct, process-specific controls or programs. Industrial robots are universally applicable automatic motion devices with a sufficient number of degrees of freedom, implemented by a corresponding number (5 to 6) axes of motion, and a freely programmable control for achieving practically any given motion trajectories of the workpiece within an area which the industrial robot can traverse or reach.

One problem with the use of such handling devices is the high impact forces from a percussive shaping machine, which during the shaping impact can impose significant stress and cause damage to the handling device when the handling device holding the workpiece is struck by the hammer or tappet. To solve this problem, DE 42 20 796 A1 and DE 100 60 709 A1 have proposed handling devices which can be flexibly positioned during the impact to damp the impact forces and vibrations transmitted from the workpiece to the drive, and which can be rigidly positioned during transport of the workpiece.

Automated handling of workpieces in forging processes with percussive shaping machines has not yet achieved widespread acceptance in actual practice. Instead, in practice the workpiece is still manually held in the forging hammer using a gripping tool, since appropriately trained operators control the correct handling of the workpiece when it is struck by the hammer along with the striking tool. After the hammer is reversed, the operator lifts the workpiece and places it back in the tool before the hammer strikes again with the next lift, or immediately places the workpiece in a depositing device.

BRIEF SUMMARY OF THE INVENTION

The object of the present invention is to provide a method and a device for shaping a workpiece, in which the lifting of the workpiece from the tool after a shaping process is automated.

This object is achieved according to the invention by a method having the features of claim 1, and a device having the features of claim 31.

The method according to claim 1 is suitable for shaping, in particular forging, at least one workpiece, and specifies and comprises the following process steps:

a) Placing the workpiece in a shaping position on a first of at least two tools of the shaping machine (positioning step), b) Moving the tools of the shaping machine toward one another, c) Shaping the workpiece between the tools, in particular in the shaping position of the workpiece on the first tool (shaping step), d) Subsequently moving the tools away from one another, e) Detecting or determining a triggering time when the relative motion of the tools is in or has reached a predetermined or predeterminable reference position, preferably during the relative motion of the tools toward one another, f) Determining or selecting a lifting time depending on or as a function of the triggering time, and g) Lifting (initiating or starting) a lifting motion of the workpiece from the first tool by at least one handling device at the lifting time.

The device according to claim 31 is suitable for shaping, in particular forging, at least one workpiece, and in particular for use in a method according to the invention, or for carrying out a method according to the invention, and specifies and comprises the following:

a) At least one shaping machine having at least two tools that are movable toward and away from one another for shaping a workpiece which is positioned or positionable on a first of the tools in a predetermined or predeterminable shaping position between the tools, b) At least one device for detecting a triggering time when the relative motion of the tools is in or has reached a predetermined or predeterminable reference position, preferably during the relative motion of the tools toward one another, c) At least one handling device for handling the workpiece, d) At least one control device for controlling or regulating the motions and positions of the handling device(s), and e) The control device determining a lifting time as a function of the triggering time and actuating at least one handling device in such a way that at least one handling device begins to lift the workpiece from the first tool at the lifting time.

The motion of the tools relative to one another during striking by the shaping machine naturally also includes the case that only one of the two tools (the first) moves relative to the floor or machine frame or some other external reference system, and the other tool (the second) remains stationary with respect to this external system, for example for a double-acting hammer, drop hammer, or screw press, as well as the case that both tools move relative to the external reference system, for a counterblow hammer, for example. The shaping position of the workpiece refers to its absolute and adjustable geometric position in space relative to an external coordinate system. The term "automatic" means that at least during lifting itself it is no longer necessary to manually intervene or hold the workpiece, since this is automatically performed by the handling devices (or robotic motion devices), generally by controlling a control device.

The invention is based on the concept that at least one handling device does not lift the workpiece from the first tool until the tools have reached a predetermined or predeterminable position, referred to here as a reference position. This allows in particular accurate control of the handling device, so that at the lifting time the workpiece has already been completely shaped between the tools, i.e., the lifting time occurs after the shaping time when shaping of the workpiece between the tools has concluded, and/or that the tools (again) move away from one another, i.e., the lifting time occurs after the reversing time of the tools, when the direction of the relative motion of the tools with respect to one another reverses. A particular advantage of controlling the handling device as a function of the tool position according to the invention is that the lifting time may be set very close to the shaping time or reversing time, thus making it possible to shorten the tool contact times and/or cycle times.

Advantageous embodiments and refinements of the method and the device for shaping a workpiece according to the invention result from the respective dependent claims of claim 1 and claim 31.

In a first advantageous embodiment, the lifting time for at least one handling device occurs at a predetermined or predeterminable time difference after the shaping time or after the reversing time. This time difference between the lifting time and the shaping time or reversing time is generally between 0 ms and 300 ms maximum, and/or a maximum of three-fourths of the time for the tools to move apart, in particular between 0 ms and 100 ms maximum, and/or a maximum of one-fourth of the time for the tools to move apart, and preferably between 0 ms and 50 ms maximum, and/or a maximum of one-eighth of the time for the tools to move apart, and/or is a function of a predetermined tool contact time.

In one preferred embodiment, at least one control device is provided which controls the motions of at least one handling device and determines the lifting time as a function of the triggering time, and at the determined lifting time initiates a lifting motion or lifting routine of the handling device.

The control device sends, in particular at a starting time, a start signal to at least one handling device, which after receiving this start signal begins a lifting motion and lifts the workpiece at the lifting time. In this embodiment, to a certain degree the handling device itself thus has possibilities for signal processing, and the actuation occurs via signals.

In general, at least one position detection device is provided which sends a trigger signal to the control device at the triggering time, when the relative position of the tools reaches the reference position, and whereby the control device determines the lifting time as a function of the input time of the trigger signal.

The position detection device may comprise a position switch which is associated with or located at a reference position, and which changes its switching state when actuated by one of the two tools, a change in switching state of the position switch being used as a trigger signal or triggering time.

However, at least one position detection device may also measure the relative position of the two tools with respect to one another continuously or at specified measuring points, and send a corresponding position measurement signal or corresponding position measurement value to the control device. The control device then compares the position measurement signal or the position measurement value to a reference signal or reference value corresponding to the reference position, and evaluates a determined agreement of the position measurement signal with the reference signal, or of the position measurement value with the reference value, as a triggering time and determines the lifting time therefrom.

In one particularly advantageous embodiment, the control device determines the lifting time from the triggering time by counting or allowing to elapse a predetermined delay time with respect to the triggering time, for example by use of a digital counter or clock. In particular, the control device may determine the starting time for the start signal by allowing to elapse or counting a predetermined delay time with respect to the triggering time, the lifting time resulting from the starting time in a well-defined manner, generally by addition of the signal propagation time and signal processing time of the start signal for the handling device. The delay time generally is a function of the progression of at least one relative motion variable in the relative motion of the tools with respect to one another, and/or is a function of an adjusted or adjustable shaping energy.

Although it is uncommon in current technology, direct regulation or control of the handling devices may be provided in all embodiments without transmission and evaluation of signals, for example by use of components or actuators which directly influence the control current for drive(s) of the handling device as a function of the relative position of the tools. Thus, for example, as soon as the relative position of the tools reaches the reference position, the position switch could immediately actuate one or more switching contacts which connect the control current(s) for the handling device, or electrical or electromechanical delay elements or delay switches could be provided, such as bimetallic relays, components with hysteresis, or the like.

The reference position for the tools preferably is selected as a function of one or more of the following process variables or conditions:

- Progression over time of the relative motion of both tools
- Value of the shaping energy for shaping the tool, or a variable uniquely correlated with the shaping energy, in particular when this value may be adjusted to one of at least two different values
- The sum of the minimum signal or data propagation times and the signal or data processing times necessary for determining the lifting time from the triggering time is less than the time interval between the lifting time and the triggering time.

The reference position may in particular correspond to the relative position of the tools at their farthest distance apart from one another, in particular the so-called TDC (top dead center) of the shaping machine, but as a rule is between the farthest relative position, in particular TDC, and the closest relative position, the striking position, in particular the BDC (bottom dead center) of the shaping machine.

In one particular embodiment, a self-learning or adaptive system is provided wherein the lifting time is automatically learned or adapted to by determining in one or more shaping steps (or tool motions) the relative position of the tools at the lifting time and adjusting the lifting time to a desired value, in particular by adapting the delay time to the triggering time, or by adjusting the reference position. In this manner the lifting time in particular may be set as close as possible to the reversing time of the tools, thereby optimizing the time sequence.

At least one handling device which lifts the workpiece also preferably places the workpiece in its shaping position on the first tool, and/or securely holds the tool in its shaping position between the tools during shaping. However, it is also possible to use different handling devices, at least at times or in parts, for the various handling actions.

The workpiece preferably is secured or held by gripping in at least two locations by a respective handling device, at least when struck by the tool(s) of the shaping machine during the shaping step. This has the primary advantage that the workpiece is fixed at two locations when struck by the tool(s), and therefore can be more reliably kept from breaking out or sliding out from the tools. Another advantage is that buckling of a long workpiece on one side can be prevented, since the handling devices are able to fix the workpiece on both sides and stabilize it during shaping.

In one advantageous embodiment, the tool also, or at least during lifting, is handled by at least two handling devices, in particular the same handling devices used for holding during shaping.

The motions and positions of the handling devices are automatically controlled or regulated by mutual coordination. When the handling device(s) is/are controlled, the motion proceeds according to a predetermined or predeterminable motion sequence or motion profile, or a correspondingly stored control program (no feedback or "open-loop control"), whereas for regulation the motions of the handling devices are metrologically determined and adjusted to predetermined target motions (reference input variables for motion) or regulated (feedback or "closed-loop control"). The motions or positions of the two handling devices are coordinated with one another to enable precise handling of the workpiece. Thus, no kinematic coupling is provided between the two handling devices when the workpiece is handled during shaping.

In one advantageous embodiment, for at least a portion of the handling of the workpiece by two handling devices, both handling devices are moved synchronously and/or along trajectories at essentially constant distance with respect to one another, and/or at essentially the same speed.

The control device controls or regulates the two handling devices, in particular the respective drive mechanisms thereof, in one embodiment according to a master-slave control principle, in which a handling device acting as the slave follows the motions of a handling device acting as the master.

In an alternative preferred embodiment, the control device controls both handling devices, in particular the drive mechanisms thereof, independently of one another, in mutually adapted control sequences.

In general, each handling device or its contact point on the workpiece travels during a motion and/or handling of the workpiece along a trajectory specified in advance with a predetermined speed characteristic, and/or follows stored successive trajectory points at regular time intervals.

The associated trajectory of the handling device or its contact point on the workpiece is preferably learned in advance, but may also be calculated. In one special embodiment, (only) the trajectory of one of at least two handling devices or their contact points on the workpiece is learned, and the trajectory of at least one additional handling device or its contact point on the workpiece is calculated in advance from the learned trajectory of the first handling device, and is stored or calculated in real time. During learning of the trajectory of a handling device or its contact point on the workpiece, in general the associated trajectory is traversed, and the trajectory points are successively detected and stored at regular time intervals. The speed characteristic during learning is preferably specified according to the subsequent speed characteristic for the process. For any given speed characteristic during learning, the actual speed characteristic during operation may also subsequently be taken into account, and new trajectory points may be calculated and stored. During movement and/or handling of the workpiece, the handling device or its contact point on the workpiece in each case follows the trajectory points stored during learning, optionally after speed correction, in the same time intervals and in the same sequence as during learning.

During handling actions at the shaping machine, the two handling devices preferably are situated on opposite sides of the working region or of the tools of the shaping machine.

In one embodiment in which the tool is shaped in at least two shaping steps between the same tools, in one variant, the workpiece is lifted from the first tool by at least one handling device after one shaping step and is then repositioned on the first tool in the shaping position for the subsequent shaping step.

Value of the shaping energy for the shaping tool, or a variable uniquely correlated with the shaping energy, in particular when this value may be adjusted to one of at least two different values.

In one preferred embodiment, in particular between two shaping steps, scale material is blown out under the lifted tool and/or from the tool by use of a blower. This step is also referred to as ventilation. The blower preferably is actuated, in particular by the control device, in such a way that the switch-on time, or the startup or initiation, for the blower is determined as a function of the triggering time (analogous to the lifting motion of the handling device), and preferably occurs after the lifting time.

In one advantageous embodiment of the device, each handling device has a) at least one gripping mechanism having at least two gripping elements that are movable relative to one another for gripping the workpiece, b) at least one support apparatus to which the gripping mechanism is or may be fastened, and c) at least one conveying device for conveying the support apparatus along with the gripping mechanism.

The device is now preferably refined by the fact that a flexible connection of the support apparatus and conveying device in a flexible state results in at least partial absorption or damping of impacts or vibrations that are transmitted from the workpiece to the handling device during the shaping process, thereby protecting the conveying device from these mechanical stresses; and that, in contrast, a rigid connection or position of the support apparatus and conveying device in a rigid state is used when the workpiece is handled during transport, or during rotation or swiveling before or after shaping steps.

Preferred applications of the invention are represented by use of a forging hammer, screw press, or crank press as the shaping machine, and/or for forging and/or cold shaping at a shaping temperature typically in the range of room temperature (21° C.), for warm shaping, typically between 550° C. and 750° C., or for hot shaping, typically above 900° C., and/or for shaping workpieces from ductile metals and metal alloys, in particular ferrous materials such as steels, as well as nonferrous metals such as magnesium, aluminum, titanium, copper, nickel, and alloys thereof. In general, the tools of the shaping machine are shaping forging die tools for combined shaping of the workpiece.

BRIEF DESCRIPTION OF THE DRAWINGS

The invention is further explained below, with reference to exemplary embodiments. In this regard reference is made to the drawings, wherein.

DETAILED DESCRIPTION OF THE PREFERRED EMBODIMENTS

Figure 1:
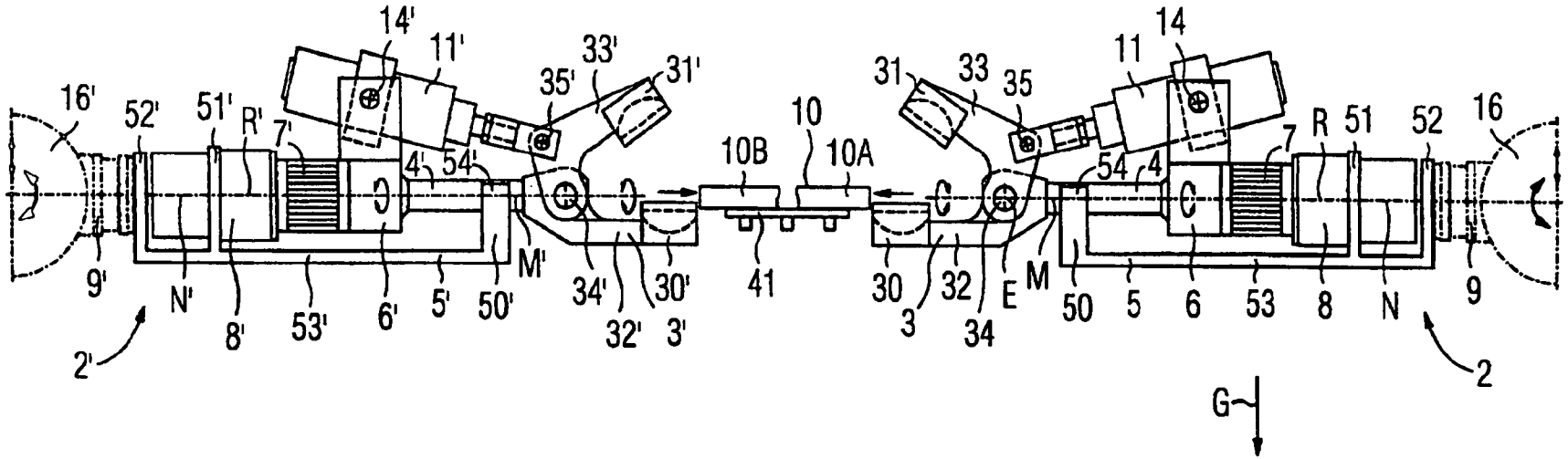
FIG. 1 shows a device having two handling devices for grasping a workpiece, in a side view.

A first handling device is designated by reference number 2, and a second handling device, by 2'. Each of the handling devices 2 and 2' may be designed as manipulators or robots. In the exemplary embodiments illustrated in FIGS. 1 through 5, both handling devices 2 and 2' have essentially the same design, each comprising a gripping mechanism (or gripping pincer) designated by 3 or 3', a support shaft by 4 or 4', a support device (or rigid control device) by 5 or 5', a bearing part by 6 or 6', a flexible element by 7 or 7', a pivot drive (or rotary drive) by 8 or 8', an articulated joint by 9 or 9', an actuating device by 11 or 11', and a conveying device by 16 or 16'.

Each gripping mechanism 3 or 3' comprises two gripping levers 32 and 33 or 32' and 33', each having an associated gripping jaw (or gripping element, pincer jaw) 30 and 31 or 30' and 31', which by means of the actuating device 11 or 11' are able to swivel with respect to one another in a swivel bearing 34 or 34' for opening and closing the gripping mechanism 3 or 3'. The actuating device 11 or 11' engages the gripping lever 33 or 33' in an engagement bearing 35 or 35', and is mounted in a swivel bearing 14 or 14' on the intermediate bearing part 6 or 6'. The gripping lever 32 or 32' of the gripping mechanism 3 or 3' is coaxially connected via the support shaft 4 or 4' to the intermediate bearing part 6 or 6'. The flexible element 7 or 7' is mounted between the intermediate bearing part 6 or 6' and the pivot drive 8 or 8', which is connected to the articulated joint 9 or 9' along a second axis N. Each of the flexible elements 7 or 7' is connected via a flange to the intermediate part 60 or 60' and the pivot drive 8 or 8', respectively, and is made of an elastic material, preferably an elastomer. The front unit of the handling device 2 or 2', namely, the gripping mechanism 3 or 3', support shaft 4 or 4', and bearing part 6 or 6', in addition to the actuating device 11 or 11' on the one hand, and the rear unit of the handling device 2 or 2', namely, the pivot drive 8 or 8' and the articulated joint 9 or 9' in addition to the conveying device 16 or 16' on the other hand, and, therefore, also the axes M and N thereof, are able to swivel or incline with respect to one another in the flexible element 7 or 7'.

Figure 2:
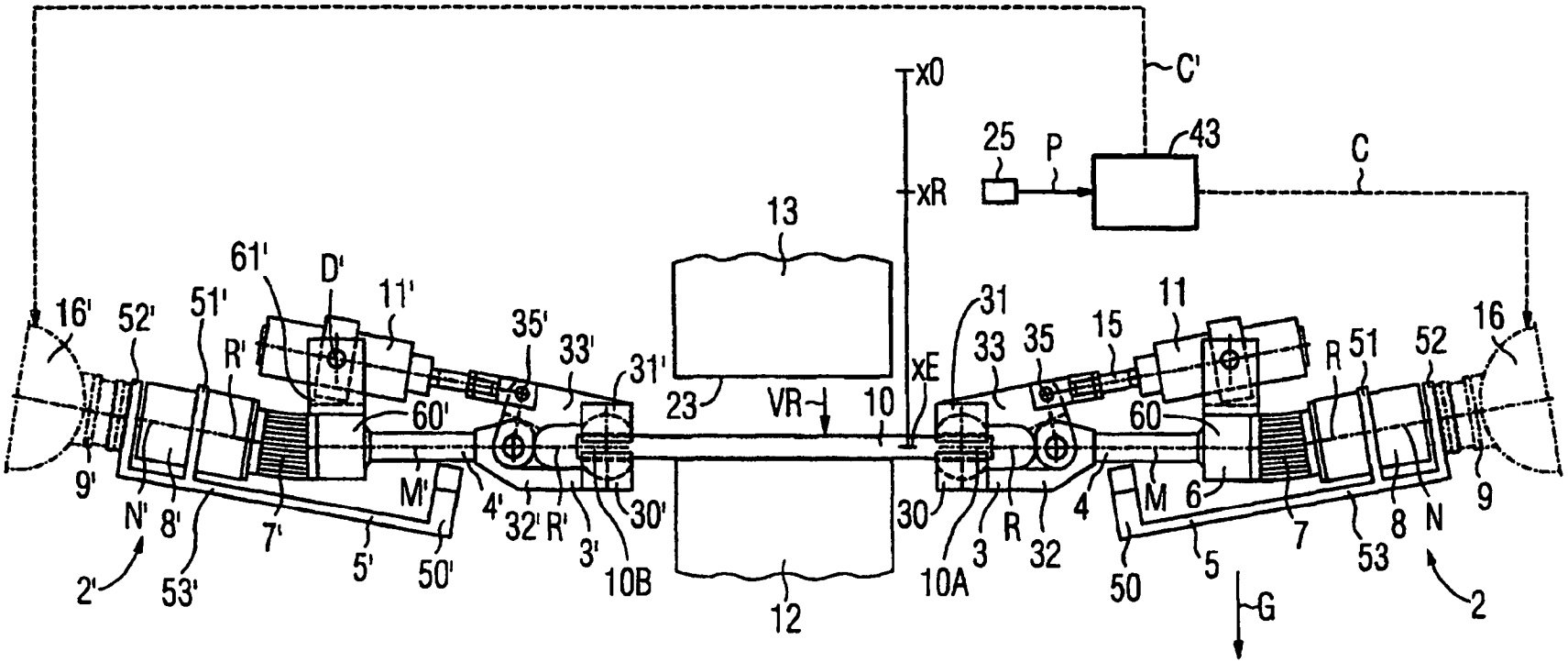
FIG. 2 shows the device according to FIG. 1, in which the two handling devices hold the workpiece placed in a shaping machine, in a side view.

The support device 5 or 5' for the handling devices 2 and 2' according to FIGS. 1 and 2 comprises a longitudinal connecting rod 53 or 53' on which are respectively situated a first fastening part 51 or 51' extending transversely upward for connecting the connecting rod 53 or 53' to the pivot drive 8 or 8', and further to the rear, a second fastening part 52 or 52' extending transversely upward for connecting to the articulated joint 9 or 9', and in the front region an upwardly projecting support part 50 or 50' having a recess or support bearing (or shaft seat) for fixing or supporting the support shaft 4 or 4'. FIGS. 1 and 2 also illustrate, among other things, the operating principle of the support device 5 or 5' and the flexible element 7 or 7' of the handling devices 2 or 2'.

In the state shown in FIG. 1, the handling devices 2 and 2' with gripping mechanisms 3 and 3' opened on both sides move in the direction of the illustrated arrows toward a workpiece 10, which is picked up on a pickup device, for example a conveyor belt 41. Axes M and N or M' and N' are oriented coaxially with respect to one another as well as horizontally, i.e., perpendicular to gravitational force G, and the flexible element 7 or 7' is essentially undeformed. The connecting rod 53 or 53' runs parallel to the axes M and N or M' and N', and its support part 50 or 50' supports the support shaft 4 or 4', and thus the gripping mechanism 3 or 3' connected thereto. The support device 5 or 5' thus represents a mechanical bridge over the flexible element 7 or 7', and in the position according to FIG. 1 removes the flexibility of the handling device 2 or 2' in the flexible element 7 or 7', at least in the three-dimensional direction of the gravitational force G, and in the downwardly directed, lateral directions between the gravitational force G and the horizontal direction. The rigid connection is maintained solely by the intrinsic weight of the parts of the handling device 2 or 2'. When they reach the workpiece 10 the gripping mechanisms 3 and 3' close, thereby grasping the workpiece 10 at its ends 10A and 10B. The workpiece is conveyed to a shaping machine by conveying devices 16 and 16', where it is placed on a tool in the shaping position for shaping. The handling device 2 or 2' is thereby held in the rigid state by the support device 5 or 5'.

FIG. 2 shows the workpiece 10 in the laid-out state on the surface 22 of the lower tool or forging die 12 of a forging hammer as a preferred example of a shaping machine. By raising the lower units of the handling devices 2 and 2', i.e., by inclining the center axis N or N' about the angle of inclination $\alpha$ or $\alpha'$ relative to the center axis M or M' of the front unit about the flexible element 7 or 7', the support device 5 or 5' is disengaged from the support shaft 4 or 4', since the support part 50 or 50' is at a sufficient distance from the support shaft 4 or 4'. During the inclined motion about angle $\alpha$ or $\alpha'$, the forging die 12 is used as an abutment via the workpiece 10. The handling devices 2 and 2' are thus in a flexible or nonrigid state in FIG. 2. If an upper tool or striking tool 13 on the striking hammer 15 of the forging hammer now strikes the workpiece 10 in the striking direction or forward direction VR, the impact and vibrational stresses thus created are damped by the elastic elements 7 or 7' and are largely decoupled from the conveying device 16 or 16' and pivot drive 8 or 8', thereby protecting these drive devices from overload.

In the rigid as well as the flexible state of the handling devices 2 and 2', in the illustrated embodiment the workpiece 10 may be rotated, in particular about a rotational axis that extends through the workpiece 10, its longitudinal axis, for example, before placing it on the forging die 12. For such a rotational or swiveling motion, the gripping mechanisms 3 and 3' together with the grasped workpiece 10 are swiveled about the desired rotational angle in the same rotational direction and at the same rotational or angular speed. To this end, a rotational motion of a drive shaft of a drive motor for the pivot drive 8 or 8' is transmitted, optionally via a transmission, through a drive flange and the flexible element 7 or 7', and through a connecting flange to the intermediate bearing part 6 or 6' and from there to the support shaft 4 or 4', and finally to the gripping mechanism 3 or 3'. Such swiveling motions occur, for example, during bending of a workpiece in a first forging process or forging step, and during subsequent flat shaping or forging. The rotatability of the gripping mechanisms 3 and 3' may be omitted if rotation is not desired.

Figure 3:
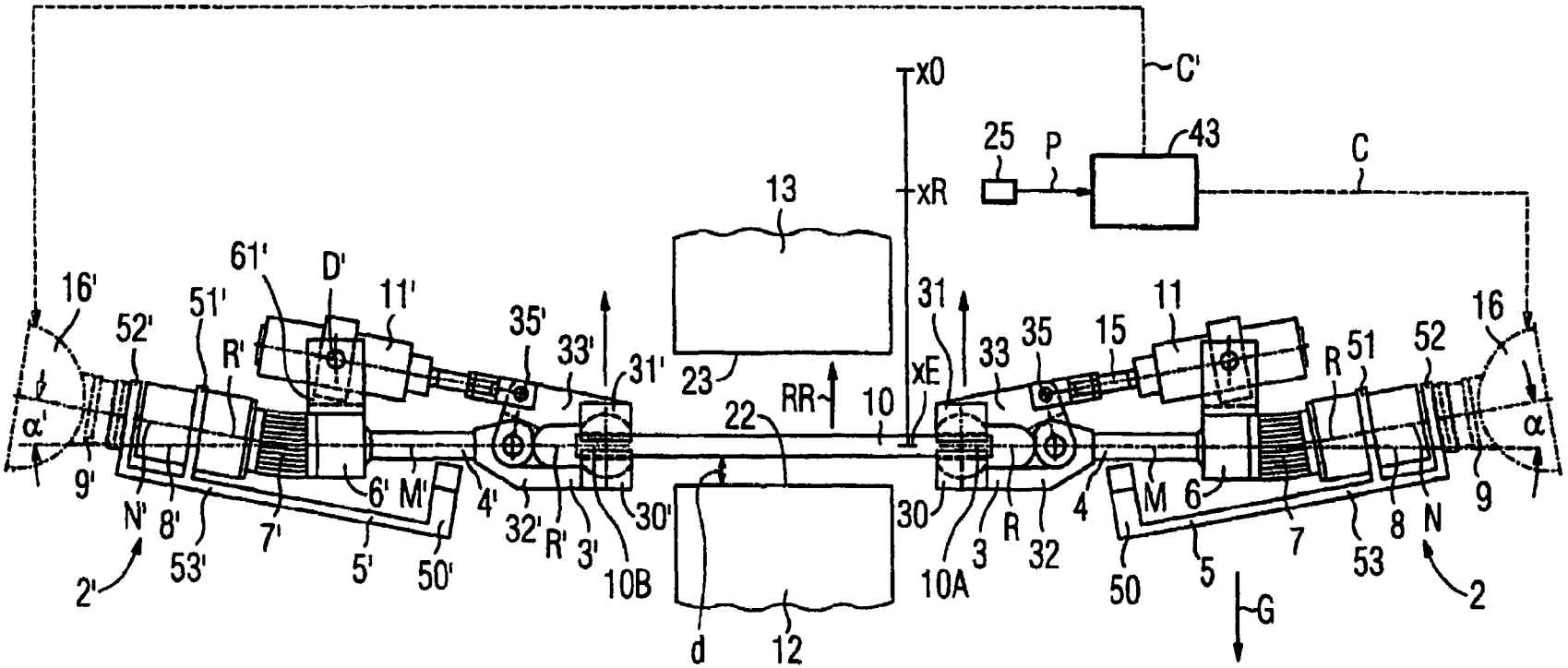
FIG. 3 shows the device according to FIG. 1 or FIG. 2, in which after the shaping impact the two handling devices lift or ventilate the workpiece located in the shaping machine, in a side view.

Proceeding from FIG. 2, FIG. 3 shows the situation shortly after the striking tool 13 strikes the workpiece 10 and the surrounding regions of the tool 12. The striking tool 13 is again set in upward motion away from the tool 12 by the recoil or, optionally, by a drive, in a backward direction RR.

The workpiece 10 is now lifted from the tool 12 by a distance d, or ventilated. This lifting or ventilating motion by the two handling devices 2 and 2' and the workpiece 10 held thereby follows the upwardly moving striking tool 13 after the shaping impact, in the same direction as the backward direction RR. The handling devices 2 and 2' may remain in the flexible position, as illustrated in FIG. 3, or may also be rigidly positioned before the lifting motion, as in FIG. 1. During or after the ventilating motion, scale material is blown out of the lower tool 12 by means of a blower, not illustrated. The lifting or ventilation also shortens the time that the workpiece 10 is in contact with the lower tool 12.

After the lifting or ventilation procedure, the workpiece 10 may now either be placed on the forging die 12 again, on another forging die, or on another gravure of the forging die 12, and may be reshaped by the striking tool 13 or another striking tool.

Figure 4:
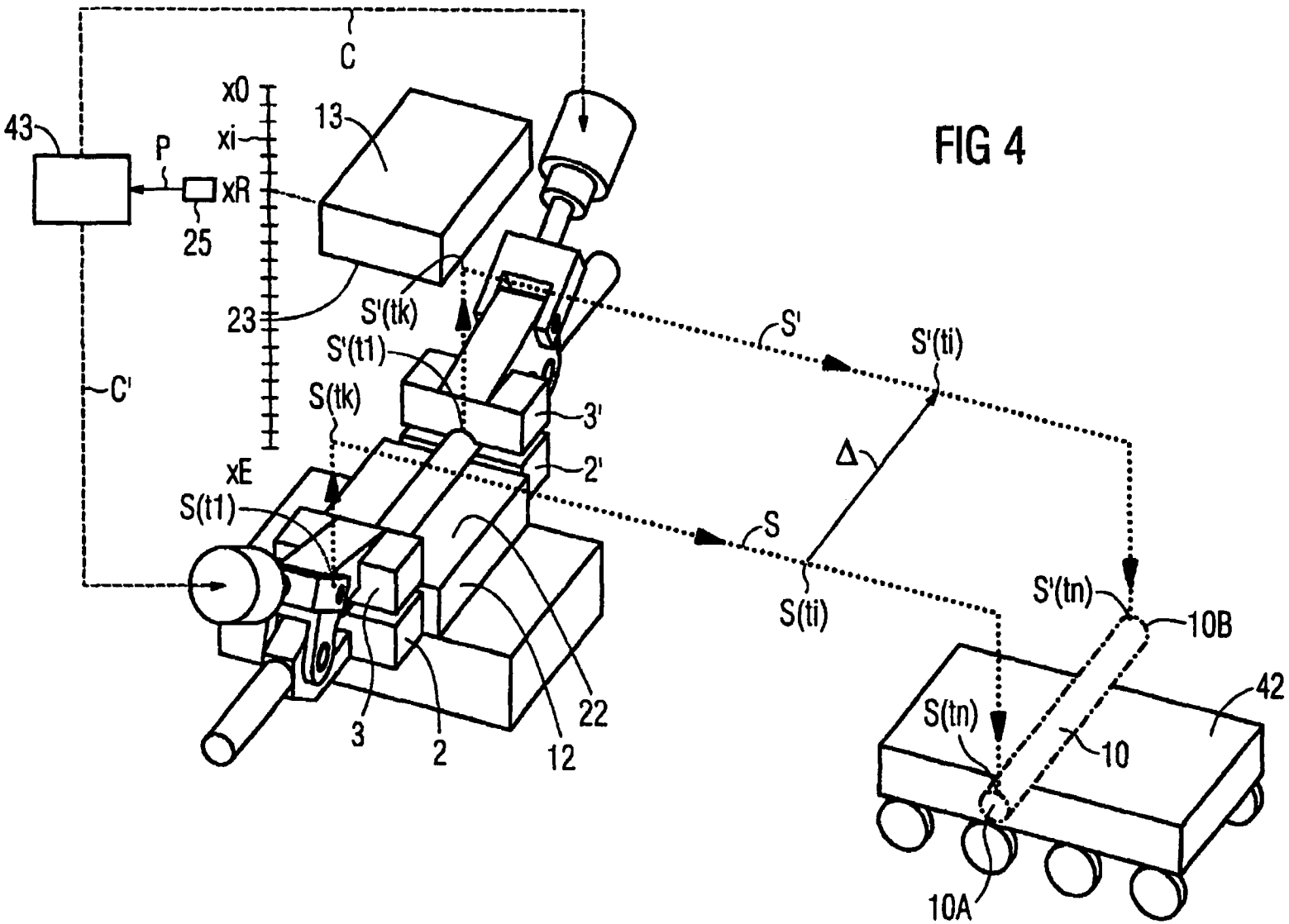
FIG. 4 shows a device for shaping a workpiece, having two handling devices which handle the workpiece along predetermined paths of motion, in a schematic perspective view.

However, the shaping process may also be ended and the workpiece 10 moved away by the two handling devices 2 and 2', out of the ventilated position shown in FIG. 3 and out of the working region of the shaping machine between the two tools 12 and 13, and conveyed to a depositing device. FIG. 4 shows such a handling of the workpiece 10 after shaping. The paths of motion or trajectories of the two handling devices 2 and 2' are designated by S and S', while the directions of motion are represented by arrows.

According to FIG. 4, the two handling devices 2 and 2' are each started at a lifting time t1 from a starting position S(t1) and S'(t1) in which the handling devices grip the workpiece 10 at each end 10A and 10B by the gripping mechanisms 3 and 3', and hold the workpiece on the forging die 12 of the shaping machine. Both handling devices 2 and 2' now initially move upward so that the workpiece 10 is lifted from the surface 22 of the forging die 12. The uppermost point of this lifting motion at time tk>t1 is designated by S(tk) or S'(tk).

Subsequent to the lifting motion, the handling devices 2 and 2' further convey the workpiece 10 along trajectories S and S', which in the illustrated example now run horizontally, and at a depositing time tn ultimately place the workpiece 10 at positions S(tn) and S'(tn) on a depositing device 42, which for example comprises a conveyor belt for conveying the finished, forged workpiece 10. The two trajectories S and S' of the handling devices 2 and 2' generally run parallel to one another, and the handling devices 2 and 2' are synchronously moved relative to one another. The motion of the workpiece 10 is therefore essentially only translational, and not rotatory. The difference vector $\Delta = S'(tj) - S(tj)$ is thus always the same at any given time tj.

According to the invention, the lifting motion of the workpiece 10 by the handling devices 2 and 2' according to FIGS. 2 through 4 is initiated or started as a function of the location or position of the striking tool 13. The position of the striking tool 13 simultaneously corresponds to the relative position of the two tools 12 and 13 with respect to one another, since the forging die 12 is stationary. During its striking motion and recovery motion, also referred to as lift, the striking tool 13 moves linearly between an upper end point x0, also referred to as top dead center (TDC), and a lower end point xE, also referred to as bottom dead center (BDC).

A position sensor 25 is situated at a predetermined reference position xR, where x0<xR<xE, and at its output supplies a position signal P. The position signal P is a measure of whether, and when, the striking tool 13 reaches the reference position xR, and then corresponds to a reference position signal PR.

The position sensor 25 may be designed as a type of position switch which receives two values or conditions, namely, a value or state when the position x of the striking tool 13 does not correspond to the reference position xR, and a second value or state, namely, a reference position value or reference position state PR when x is equal to xR. To this end, a contactless position sensor or position switch is generally used which reacts to a locally delimited trigger point on the tool 13, a magnetic position sensor, for example, which responds to a marking made of magnetic material on the striking tool 13.

In another embodiment, the position sensor 25 may also continuously or semicontinuously detect and determine the position x of the striking tool 13 over the entire path length of x0 to xE and back, in individual measurement points xi. The position signal P is then an injective or bijective function of the position x or xi when P(xR)=PR. To this end, for example a strip or similarly designed marking may be provided on the striking tool 13, parallel to the path length or coordinate direction x, which allows the position to be incrementally detected by means of a pattern which changes in small increments or steps.

The described position detection systems are known as such, and therefore do not require a more detailed description. The position sensor 25 may in particular be an optical, inductive, or magnetic field sensor.

The position signal P from the position sensor 25 is fed to a control device 43, which decides based on the position signal P whether, and when, to initiate a lifting motion of the handling devices 2 and 2'. For this purpose the control device 43 is mechanically linked to the handling devices 2 and 2', and controls the handling devices 2 and 2' by associated control signals C and C'. As soon as the striking tool 13 reaches the reference position xR in downward motion, i.e., in the direction of the forward direction VR, the position sensor 25 sends a corresponding reference position signal P=PR to the control device 43. The control device 43 accepts the input time of the reference position signal PR as the triggering time tR, at which time a lifting routine is initiated in the control device 43. According to an algorithm or calculation method stored in the control device 43, a starting time is now determined at which the start signals C and C' are sent to the handling devices 2 and 2'. After the synchronous start signals C and C' are received by both handling devices 2 and 2', the drive systems for the handling devices 2 and 2', in particular the conveying devices 16 and 16', are actuated so that at a lifting time t1 according to FIG. 4 the lifting motion of the workpiece 10 begins, and the handling devices 2 and 2' move upward along their trajectories S and S'.

The lifting time t1 occurs at a system-related reaction time and at the signal propagation times for start signals C and C', as well as at the signal processing times in the handling devices 2 and 2' which are later than the starting time in the control device 43, and at a further time difference which is determined by the computing times in the control device 43 and by the signal propagation times for the position signal P, which are later than the time at which the striking tool 13 has reached the reference position xR. Since these delay times in the system may be determined in advance, or are within limits that may be determined in advance, the lifting time t1 may be chosen to be very close to the reversing time of the striking tool 13 when the striking tool 13 reverses its direction from the forward direction VR to the backward direction RR. This initiation of the lifting motion of the handling devices 2 and 2' at the moment of reversal or shortly thereafter means a short tool contact time, which in turn increases the tool service life and the productivity. The delay times occurring as a result of the signal transmission times and computing times are compensated for by the starting of the handling devices 2 and 2' during the downward motion of the striking tool 13.

To determine the starting time at which the start signals C and C' are sent from the control device 43 to the handling devices 2 and 2', a delay time is preferably allowed to elapse in the control device 43 after the reference position signal PR is received from the position sensor 25, for example by use of a digital counter or an integrated clock. The start signal C or C' is sent after the delay time has elapsed. An associated delay time is assigned to each adjusted shaping energy of the shaping machine. This relationship between the adjusted shaping energy and the delay time may be produced in the control device 43 using a mathematical function or a value table.

When a continuous position detection system is used in which the position x between x0 and xE is known at every point, an individual reference position xR for the striking tool 13, and thus an individual starting point for the handling devices 2 and 2', may also be assigned for each adjusted shaping energy of the shaping machine. This relationship between the reference position xR and the starting point for the handling device may also be produced in the control device 43 using a mathematical function or a value table.

In addition to the position x, xi, or xR, the speed dx/dt of the striking tool 13 may also be calculated in the control device 43, for example by numerical differentiation based on the received values xi or x for the position of the striking tool 13. It is thus possible to assign to each speed an individual starting point for the handling devices 2 and 2'. This relationship between the starting point for the handling devices 2 and 2' and the speed of the striking tool 13 may also be produced in the control device 43 using a mathematical function or a value table.

In a typical operating mode of a shaping device according to the invention, the shaping machine operates with, for example, two different shaping energies. A starting point for the handling devices 2 and 2' results from each of the two adjustable shaping energies, based on the mathematical function or the value table with the assistance of the control device 43. For a position detection system in the shaping machine, in the control device 43 the target value as a calculated starting point is compared to the actual value or actual position of the striking tool 13. From the comparison of the target and actual values, the control device 43 forms the start signal C or C' for the handling devices 2 and 2' when the target value is reached.

As a rule, the tools 12 and 13 are shaping tools, so-called forging dies, having gravures correspondingly matched to the desired shape of the workpiece. The handling devices 2 and 2' generally hold the workpiece 10 during the entire forging cycle, and jointly and synchronously perform all handling motions necessary for the forging process. The joint, synchronous travel of both handling devices 2 and 2' is achieved by means of an electrical coupling between the two handling devices 2 and 2', the coupling being made by the master-slave operation of electrical drives, or by the simultaneous starting of independently operating drives. The motions of the handling devices 2 and 2', and thus the handling motions for the workpiece 10, are generally learned in advance in a manner known as such.

The control device 43 may also perform the entire signal exchange. As a rule, the control device operates with the assistance of at least one digital processor, in particular a microprocessor or digital signal processor, and corresponding memories in which the sequence programs, control algorithms, and data for the motions are stored. Master-slave control devices known as such may be used for a master-slave operation. For independently operating drives, identical distances and speeds as well as error feedback and error responses are provided between the independent drives to ensure precise and, in the event of malfunctions, reliable operation.

Figure 5:
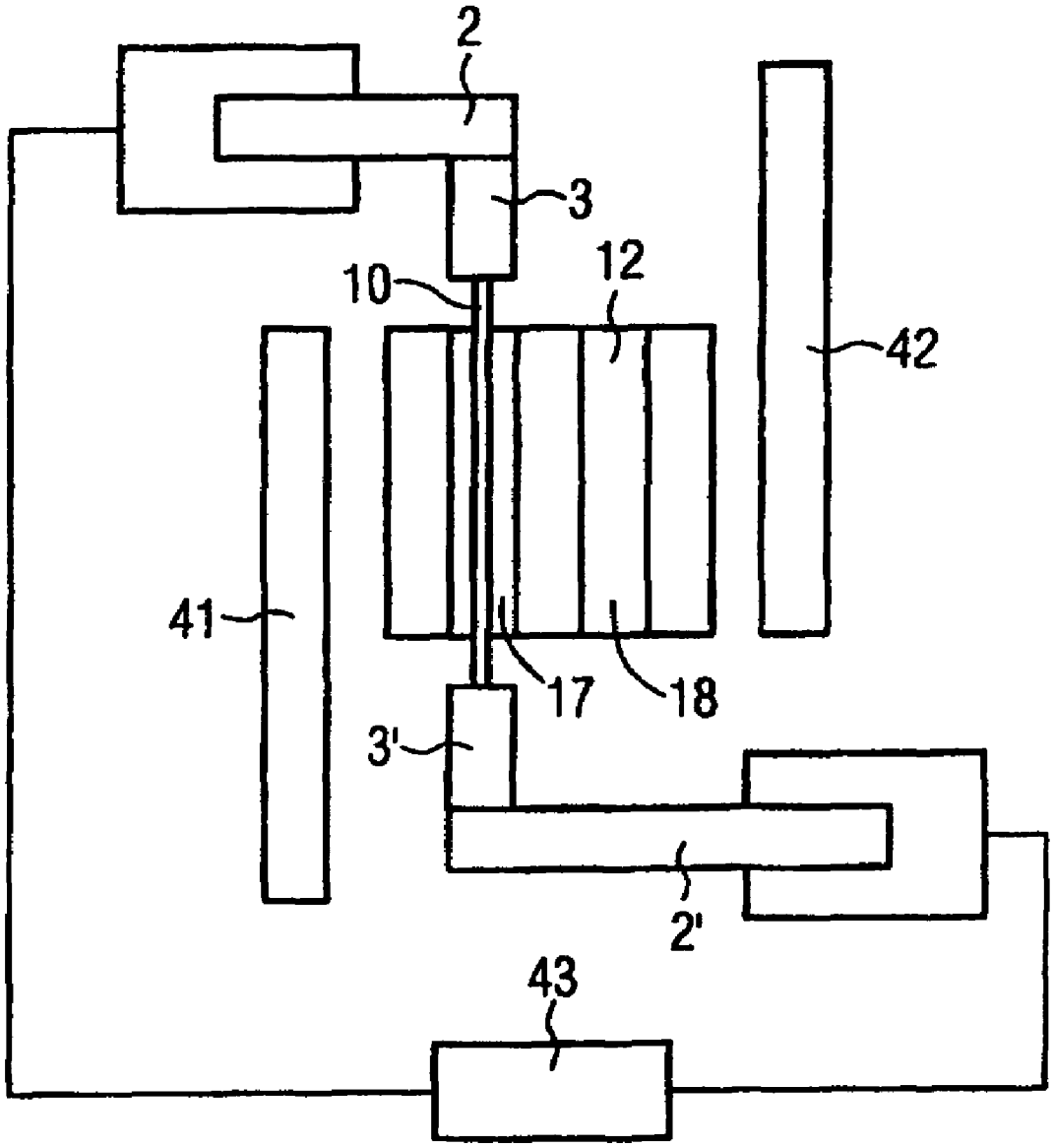
FIG. 5 shows a device for shaping a workpiece, having two handling devices, during handling of the workpiece, in a top view, each in schematic representation. Corresponding variables and parts are provided with identical reference numbers in FIGS. 1 through 5.

FIG. 5 shows a further exemplary embodiment of a device for handling a workpiece during a forging process. This device once again comprises two handling devices 2 and 2' with respective gripping mechanisms 3 and 3', schematically illustrated as industrial robots. The two handling devices 2 and 2' take a workpiece 10 from a pickup device 41, such as a feed conveyor belt or other automated supply device, for example, and place the workpiece in a first gravure 17 in a tool 12 of a percussive forging die shaping machine. The counter-tool or striking tool of this forging die shaping machine is not illustrated, but in the top view shown would be located above the plane of the drawing. During or at the end of the handling motion, or the transfer motion from the pickup device 41 to the first gravure 17 in the tool 12, the striking tool of the shaping machine is actuated. After the striking action has been actuated, a new sequence is initiated for further handling of the workpiece 10 at a time during or at the end of the striking motion by the striking tool. The workpiece 10 is then fixed in its shaping position on the gravure 17 by both handling devices 2 and 2' and held securely at both ends, up until and during the time that the striking tool strikes the workpiece 10. After the workpiece 10 is struck and released by the striking tool, the workpiece 10 is jointly and synchronously handled by both handling devices 2 and 2' according to the stored routine for further handling. The workpiece 10 is then ventilated, as already described with reference to FIG. 3, and then is either processed once again in the first gravure 17 or immediately transferred to the second gravure 18 in the tool 12. After the workpiece is transferred to the second gravure 18 a shaping step is carried out again, with triggering of . . . [omission in source]. After the striking motion is actuated, once again the further joint, synchronous handling of the workpiece 10 is initiated at an adjustable point in time during or at the end of the striking motion. The workpiece may now be jointly and synchronously ventilated again by both handling devices 2 and 2' in the second gravure 18 and, optionally, inserted once again into the gravure 18 for additional processing, or the workpiece 10 may be immediately transferred to the depositing device 42 for the finished, shaped workpiece 10.

In addition to the embodiments described with reference to FIGS. 1 through 5, other manipulators or industrial robots may also be used for the handling devices 2 and 2', such as the aforementioned handling devices according to DE 42 20 796 A1 and DE 100 60 709 A1, for example. In addition to the described handling motions, as an addition or alternative thereto other handling motions may also be provided by handling devices 2 and 2', with or without the workpiece 10. The distance between the gripping mechanisms, distance vector Δ in FIG. 4, for example, generally depends on the length, or the dimension measured along this distance, of the workpiece, and as a rule remains constant during the joint and synchronous handling. However, a change in the volume or the shape of the workpiece after the shaping process, in particular a lengthening of the workpiece, may also be considered. This is achieved by changing the contact points of the handling devices 2 and 2' on the workpiece, such as by gripping farther out for a lengthening of the workpiece, for example. In addition, the motion trajectories of both handling devices may also differ from one another in a mutually matched fashion, for example in an offset or correction, for example, if the workpieces have different ridges or some other different shape at the contact areas. An error communication via the control device 43 allows the process to be interrupted, in particular the handling devices to be stopped, when there is an impermissible deviation of one of the handling devices from the specified trajectory at a given point in time.

LIST OF REFERENCE NUMBERS

2, 2' Handling device
3, 3' Gripping mechanism
4, 4' Support shaft
5, 5' Support device
6, 6' Bearing part
7, 7' Flexible element
8, 8' Rotary drive
9, 9' Articulated joint
10, 10' Workpiece
11, 11' Actuating device
12 Forging die
13 Striking tool
14, 14' Swivel bearing
16, 16' Conveying device
17, 18 Gravure
30, 31, 30', 31' Gripping jaw
32, 33, 32', 33' Gripping lever
34, 34' Swivel bearing
35, 35' Engagement bearing
41 Pickup device
42 Depositing device
43 Control device
50, 50' Support part
51, 52, 51', 52' Fastening part
53, 53' Connecting rod
M, M' Front axis
N, N' Rear axis
A Impact direction
B, C Axis
D, E Swivel axis
F Swivel axis
G Gravitational force
R Rotational axis

The invention claimed is:

1. A method for shaping at least one workpiece, comprising:

placing a workpiece in a shaping position on a first of at least two tools of a shaping machine, wherein at least one handling device places the workpiece in its shaping position on the first tool;

moving the tools of the shaping machine toward one another;

shaping the workpiece between the tools, wherein at least one handling device securely holds the workpiece in its shaping position between the tools during shaping;

moving the tools subsequently away from one another;

detecting a triggering time when the relative position of the tools has reached a predetermined reference position during the relative motion of the tools toward one another;

lifting the workpiece from a first tool of the at least two tools utilizing at least one handling device beginning at a lifting time; and selecting the lifting time as a function of the triggering time.

2. A method according to claim 1, wherein determining the lifting time for at least one handling device is conducted so that the lifting time does not occur before a shaping time, when the shaping of the workpiece between the tools is concluded, or before a reversing time, when the direction of the relative motion of the tools with respect to one another reverses.

3. A method according to claim 2, wherein selecting or determining the lifting time for at least one handling device is conducted so that the lifting time occurs a predetermined time difference after at least one of the shaping time and the reversing time.

4. A method according to claim 3, wherein the time difference between the lifting time and the shaping time is selected from at least one of between 0 ms and 300 ms and equal to or less than three-fourths of the time for the tools to move apart.

5. A method according to claim 4, wherein the time difference between the lifting time and the shaping time is selected from at least one of between 0 ms and 100 ms and equal to or less than one-fourth of the time for the tools to move apart.

6. A method according to claim 5, wherein the time difference between the lifting time and the shaping time is selected from at least one of between 0 ms and 50 ms maximum and equal to or less than one-eighth of the time for the tools to move apart.

7. A method according to claim 4, wherein the time difference between the lifting time and the shaping time is selected as a function of a predetermined tool contact time.

8. A method according to claim 1, wherein one of the at least two tools moves relative to an external reference system, and the other of the at least two tools remains stationary with respect to the external reference system.

9. A method according to claim 1, wherein the workpiece is shaped in at least two shaping steps, each shaping step utilizing the same tools to shape the workpiece.

10. A method according to claim 9, wherein, during shaping of the workpiece, the workpiece is lifted from the first tool by at least one handling device after an initial amount of shaping and is then repositioned on the first tool in the shaping position as part of subsequent shaping and to allow for ventilation by a blower.

11. A method according to claim 1, wherein the workpiece is shaped in at least two shaping steps between different tools or tool regions, the workpiece being lifted from the first tool by at least one handling device after one shaping step and is then positioned on the first tool in another tool region or placed in another tool in the shaping position for the subsequent shaping step.

12. A method according to claim 11, wherein after the shaping step or subsequent shaping step and after being lifted from the tool or tool region, each workpiece is conveyed by at least one handling device to a depositing device and is deposited at the depositing device.

13. A method according to claim 11, wherein at least one control device is provided which controls the motions of at least one handling device, which determines the lifting time as a function of the triggering time and initiates a lifting motion of the handling device at the determined lifting time.

14. A method according to claim 13, wherein at least one position detection device is provided which sends a trigger signal to the control device at the triggering time, when the relative position of the tools reaches the reference position, and wherein the control device determines the lifting time as a function of the input time of the trigger signal.

15. A method according to claim 14, wherein:

the position detection device comprises a position switch which is associated with or located at a reference position, whereby the position detection device changes its switching state when actuated by one of the two tools; and a change in a switching state of the position switch is used as a trigger signal or triggering time.

16. A method according to claim 13, further comprising at least one position detection device configured to:

(i) measure the relative position of the two tools with respect to one another continuously and/or at specified measuring points; and (ii) send one of a corresponding position measurement signal and a corresponding position measurement value to the control device, wherein the control device is configured to:

(a) compare the one of the position measurement signal and the position measurement value to one of a reference signal or reference value corresponding to the reference position;

(b) use the agreement of the position measurement signal with the reference signal, or the position measurement value with the reference value, as a triggering time; and (c) determine the lifting time based on the triggering time.

17. A method according to claim 13, wherein the relative speed and/or relative acceleration of the two tools is determined by the reference position of the two tools, and the lifting time is determined from the triggering time as a function of at least one of the determined relative speed and the relative acceleration of the two tools.

18. A method according to claim 13, wherein the lifting time is determined from the triggering time by allowing a predetermined delay time to elapse with respect to the triggering time.

19. A method according to claim 13, wherein:

at a starting time, the control device sends a start signal to at least one handling device; and after receiving the start signal, the at least one handling device begins a lifting motion and lifts the workpiece at the lifting time.

20. A method according to claim 19, wherein:

the control device determines the starting time for the start signal by one of allowing time to elapse or counting a predetermined delay time with respect to the triggering time; and the lifting time occurs relative to the starting time in a well-defined manner.

21. A method according to claim 20, wherein the lifting time is determined relative to the starting time by adding the signal propagation time and signal processing time of the start signal for the handling device.

22. A method according to claim 18, wherein the delay time is predetermined as a function of the progression of at least one relative motion variable in the relative motion of the tools with respect to one another, and/or as a function of an adjusted or adjustable shaping energy.

23. A method for shaping at least one workpiece, comprising:

placing a workpiece in a shaping position on a first of at least two tools of a shaping machine;

moving the tools of the shaping machine toward one another;

shaping the workpiece between the tools, wherein the shaping energy for shaping the workpiece, or a variable correlated with the shaping energy, is adjustable to one of at least two different values;

subsequently moving the two tools away from one another;

wherein a triggering time is detected when the relative position of the tools has reached a predetermined reference position during the relative motion of the tools toward one another;

beginning to lift the workpiece from the first tool at a lifting time utilizing at least one handling device; and determining the lifting time as a function of the triggering time;

wherein:

the reference position for the tools is determined by the progression over time of the relative motion of both tools;

the reference position for the tools is set as a function of one of the adjusted value of the shaping energy and the variable correlated with the shaping energy; and the reference position for the tools is determined so that one or both of the sum of the minimum signal or data propagation times, and the signal or data processing times necessary for determining the lifting time from the triggering time, is less than the time interval between the lifting time and the triggering time.

24. A method according to claim 23, wherein the reference position for the tools is determined by one of the shaping energy for shaping the workpiece and a variable correlated with the shaping energy.

25. A method according to claim 23, wherein the reference position corresponds to the relative position of the tools at their distance farthest apart from one another.

26. A method according to claim 23, wherein the reference position is between the relative position of the tools at their distance farthest apart from one another and the closest relative position of the tools.

27. A method according to claim 23, wherein the workpiece is handled at least during lifting by at least two handling devices, the motions and positions of the handling devices being automatically controlled or regulated by mutual coordination.

28. A method according to claim 27, wherein the lifting time is learned or adaptively determined by determining the relative position of the tools at the lifting time and adjusting the lifting time to a desired value.

29. A method according to claim 28, wherein the lifting time is adaptively determined by one or both of adapting the delay time to the triggering time and adjusting the reference position.

30. A method according to claim 23, wherein scale material is blown from under one or both of the lifted tool and the first tool utilizing at least one blower.

31. A method according to claim 29, wherein a switch-on time for the blower is determined as a function of the triggering time.

32. A method according to claim 31, wherein the switch-on time occurs after the lifting time.

33. A method according to claim 30, wherein a forging hammer, screw press, or crank press is provided as the shaping machine.

34. A device for shaping at least one workpiece, comprising:

a) at least one shaping machine having at least two tools that are movable toward and away from one another for shaping a workpiece which is placed on a first of the tools in a predetermined shaping position between the tools;

b) at least one position detection device for detecting a triggering time when the relative motion of the tools has reached a predetermined reference position;

c) at least one handling device for handling the workpiece, wherein:

at least one handling device places the workpiece in a shaping position on one of the at least two tools; and at least one handling device securely holds the workpiece in its shaping position between the tools during shaping; and d) at least one control device for controlling or regulating the motions and positions of the handling device(s);

e) the control device determining a lifting time as a function of the triggering time and actuating at least one handling device in such a way that at least one handling device begins to lift the workpiece from the first of the tools at the lifting time.

35. A device according to claim 34, wherein each handling device comprises:

a) at least one gripping mechanism having at least two gripping elements that are movable relative to one another for gripping the workpiece, b) at least one support apparatus to which the gripping mechanism can be fastened, and c) at least one conveying device for conveying the support apparatus along with the gripping mechanism.

36. A device according to claim 34, wherein the support apparatus and the conveying device in a flexible state are connected to one another in a flexible manner, and wherein the support apparatus and the conveying device in a rigid state are effectively one or both of connected to one another in a rigid manner and positioned relative to one another in a rigid manner, in at least one or both of one three-dimensional direction and each rotational position of one or both of the gripping mechanism and the gripping element(s).

37. A device according to claim 35, wherein the support apparatus and the conveying device are connected to one another by at least one connecting element, and wherein the connecting device in the flexible state is flexible and in the rigid state is rigid.

38. A device according to claim 35, wherein:

the support apparatus and the conveying device are connected to one another by at least one flexible element, wherein:

when the support apparatus and the conveying device are in the flexible state, the support apparatus and the conveying device are connected only via the flexible element; and when the support apparatus and the conveying device are in the rigid state, the support apparatus and the conveying device are effectively supported relative to one another by at least one support device which bridges the flexible element.

39. A device according to claim 34, wherein the tools of the shaping machine comprise shaping forging die tools for combined shaping of the workpiece.

40. A device according to claim 34, wherein the shaping machine comprises one or more of a forging hammer, screw press, or crank press.

41. A device according to claim 34, having at least one blower for blowing scale material from under one or both of the lifted tool and the first tool.

42. A device according to claim 41, wherein each blower is switched on by the control device at a switch-on time, and the control device determines the switch-on time as a function of the triggering time.

43. A device according to claim 42, wherein switch-on time occurs after the lifting time.

44. A device according to claim 34, wherein the detecting of a triggering time when the relative position of the tools has reached a predetermined reference position is conducted during the relative motion of the tools toward one another.

45. A method for shaping at least one workpiece, comprising:

placing a workpiece in a shaping position on a first of at least two tools of a shaping machine;

moving the tools of the shaping machine toward one another;

shaping the workpiece between the tools;

moving the tools subsequently away from one another;

detecting a triggering time when the relative position of the tools has reached a predetermined reference position;

lifting the workpiece from a first tool of the at least two tools utilizing at least one handling device beginning at a lifting time; and selecting the lifting time as a function of the triggering time;

wherein the shaping machine comprises at least one position detection device configured to:

(i) measure the relative position of the two tools with respect to one another continuously and/or at specified measuring points; and (ii) send one of a corresponding position measurement signal and a corresponding position measurement value to the control device, wherein the control device is configured to:

(d) compare the one of the position measurement signal and the position measurement value to one of a reference signal or reference value corresponding to the reference position;

(e) use the agreement of the position measurement signal with the reference signal, or the position measurement value with the reference value, as a triggering time; and (f) determine the lifting time based on the triggering time.

46. A device for shaping at least one workpiece, comprising:

at least one shaping machine having at least two tools that are movable toward and away from one another for shaping a workpiece which is placed on a first of the tools in a predetermined shaping position between the tools;

at least one position detection device for detecting a triggering time when the relative motion of the tools has reached a predetermined reference position;

at least one handling device for handling the workpiece;

at least one control device for controlling or regulating the motions and positions of the handling device(s);

the control device determining a lifting time as a function of the triggering time and actuating at least one handling device in such a way that at least one handling device begins to lift the workpiece from the first of the tools at the lifting time; and at least one blower for blowing scale material from under one or both of the lifted tool and the first tool;

wherein:

each blower is switched on by the control device at a switch-on time;

the control device determines the switch-on time as a function of the triggering time; and wherein switch-on time occurs after the lifting time.

* * * * *